US009617813B2

(12) United States Patent
Ross

(10) Patent No.: US 9,617,813 B2
(45) Date of Patent: Apr. 11, 2017

(54) SINGLE ACTION, DUAL POSITION, WEIGHT-DOWN LOCATING ASSEMBLY

(71) Applicant: HALLIBURTON ENERGY SERVICES, INC., Houston, TX (US)

(72) Inventor: Colby M. Ross, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/375,063

(22) PCT Filed: Aug. 26, 2013

(86) PCT No.: PCT/US2013/056689
§ 371 (c)(1),
(2) Date: Jul. 28, 2014

(87) PCT Pub. No.: WO2015/030715
PCT Pub. Date: Mar. 5, 2015

(65) Prior Publication Data

US 2016/0160590 A1 Jun. 9, 2016

(51) Int. Cl.

| | |
|---|---|
| ***E21B 23/01*** | (2006.01) |
| ***E21B 33/129*** | (2006.01) |
| ***E21B 23/02*** | (2006.01) |

(52) U.S. Cl.
CPC ..... *E21B 23/01* (2013.01); *E21B 23/02* (2013.01); *E21B 33/129* (2013.01)

(58) Field of Classification Search
CPC ..... E21B 23/02; E21B 34/14; E21B 23/01; E21B 33/129; E21B 33/1292; E21B 33/134; E21B 34/12
See application file for complete search history.

(56) References Cited

U.S. PATENT DOCUMENTS

| | | | | |
|---|---|---|---|---|
| 4,253,521 A | | 3/1981 | Savage | |
| 4,437,522 A | * | 3/1984 | Krause, Jr. | E21B 23/02 166/217 |
| 4,745,973 A | * | 5/1988 | Semar | E21B 23/02 166/208 |
| 4,896,721 A | | 1/1990 | Welch | |
| 4,984,631 A | * | 1/1991 | Reesing | E21B 33/12 166/115 |
| 5,170,843 A | | 12/1992 | Taylor | |
| 5,479,989 A | * | 1/1996 | Shy | E21B 34/06 166/332.4 |

(Continued)

*Primary Examiner* — Daniel P Stephenson
(74) *Attorney, Agent, or Firm* — McGuireWoods LLP

(57) ABSTRACT

A locating assembly includes an inner mandrel and an outer mandrel. The outer mandrel is connected to the inner mandrel via a frangible device. The locating assembly also includes a positioning device connected to the outer mandrel. Further, the locating assembly is directly or operatively connected to a tool, and the tool is located within a wellbore. An application of a first downward force causes the positioning device to move to a first position, and, when the positioning device is in the first position, the tool is located and maintained in a first position. An application of a second downward force causes the inner mandrel to move relative to the outer mandrel into a second position, and, when the inner mandrel is in the second position, the tool is located and maintained in a second position.

20 Claims, 13 Drawing Sheets

(56) References Cited

U.S. PATENT DOCUMENTS

| | | | | |
|---|---|---|---|---|
| 6,059,041 | A * | 5/2000 | Scott | E21B 23/00 166/323 |
| 2008/0230230 | A1 | 9/2008 | Giacomino et al. | |
| 2010/0282475 | A1 | 11/2010 | Darnell et al. | |
| 2011/0232899 | A1* | 9/2011 | Porter | E21B 33/128 166/181 |
| 2015/0260004 | A1* | 9/2015 | Pickle | E21B 33/04 166/386 |
| 2016/0160590 | A1* | 6/2016 | Ross | E21B 23/02 166/382 |

* cited by examiner

SINGLE ACTION, DUAL POSITION, WEIGHT-DOWN LOCATING ASSEMBLY

TECHNICAL FIELD

A single-action, dual position, weight-down locating assembly and methods of use are provided. The locating assembly can be used to locate and maintain a downhole tool in a first weight-down position and a second weight-down position. The downhole tool can be used in an oil or gas operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1A:
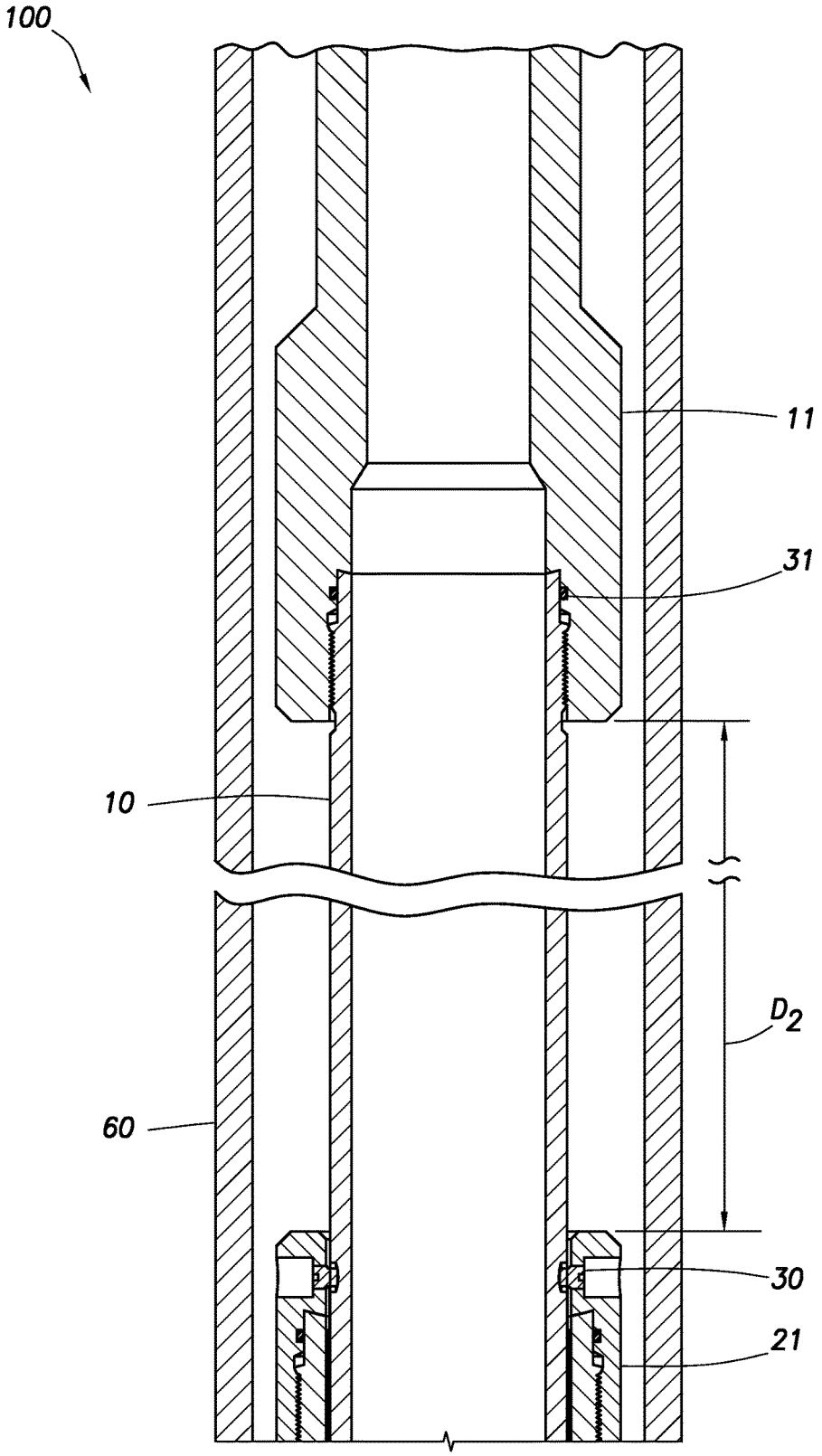
FIGS. 1A-1C is a schematic illustration of a dual position, weight-down locating assembly prior to movement of the assembly into a first and second weight-down position.

As used herein, the words "comprise," "have," "include," and all grammatical variations thereof are each intended to have an open, non-limiting meaning that does not exclude additional elements or steps.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. It should be understood that, as used herein, "first," "second," "third," etc., are arbitrarily assigned and are merely intended to differentiate between two or more positions, components, etc., as the case may be, and does not indicate any particular orientation or sequence. Furthermore, it is to be understood that the mere use of the term "first" does not require that there be any "second," and the mere use of the term "second" does not require that there be any "third," etc.

Oil and gas hydrocarbons are naturally occurring in some subterranean formations. In the oil and gas industry, a subterranean formation containing oil, gas, or water is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, an injection well, or a geothermal well. As used herein, a "well" includes at least one wellbore. The wellbore is drilled into a subterranean formation. The subterranean formation can be a part of a reservoir or adjacent to a reservoir. A wellbore can include vertical, inclined, horizontal portions, beyond horizontal portions, and up-dips, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. Oil or gas operations can be performed on-land or off-shore. For off-shore operations, the wellbore penetrates a subterranean formation located under land and the surface of the land can be located hundreds to thousands of feet below the surface of a body of water. A body of water includes, without limitation, a river, a pond, a lake, a gulf, or an ocean. A subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device.

During well completion, it is commonly desired to seal a portion of an annulus so fluids will not flow through the annulus but rather flow through the tubing string or casing. By sealing the portion of the annulus, oil, gas, water, or combinations thereof can be produced in a controlled manner through the wellhead via the tubing string or casing. Different tools can be used to create seals in the well. Examples of such tools include packers and bridge plugs.

Packers can be utilized to seal the annulus in a wellbore. Typically, packers are used to anchor the tubing to the wellbore and to seal the tubing to the wellbore. A packer can be used in cased wellbore portions or open-hole wellbore portions. A packer can include an element that seals to the wellbore to isolate a portion of the wellbore and may also contain slips that grip the inside of a casing or wall of the wellbore to anchor the packer to the casing or wellbore wall. Rubber elements are used to create a seal in the wellbore. A setting method can activate or energize the packing elements and slips while a releasing method can return the packer to the un-set position. A packer can use a setting tool to apply compression to energize the packing element and slips.

A packer can be introduced into or run into the wellbore on a work string or on production tubing during the course of treating and preparing the well for production, commonly called completion operations. The packer can act as an isolation device. For example, the packer can be used to substantially seal the annulus between the outside of the production tubing and the inside of the casing or wall of the wellbore by blocking the movement of fluids through the annulus past the packer location. Packers can also be used as service tools.

There are several tools that require an operator to be able to locate the tool within a wellbore such that the tool is positioned in an exact location within the wellbore. After a tool is located, it is often necessary to maintain the tool in the located position. By way of example, it is often necessary to locate a tool within the wellbore so an operator can be assured that another downhole component is moved into a correct position. For example, proper location of a tool can indicate whether a sliding sleeve has moved into an open or closed position. Then, once the tool is located, an operator can be assured that the sleeve does not move into another position because the tool is maintained in the located position. This can allow the operator to ensure that the desired fluid flow paths within the wellbore and through one or more tools are maintained.

However, when the length of the wellbore is very long, the tubing string connected to the tools can stretch. The stretching of the tubing string results from a variety of factors including, the large of amount of weight of the entire tubing string that can act under the force of gravity to pull and stretch the tubing string, and the temperature of the formation. For example, higher formation temperatures can heat the tubing string, thus allowing the physical properties of the metal to change, for example, causing elongation of the metal. The change in properties can allow the tubing string to stretch or shrink. As wellbores have become increasingly longer, especially in off-shore drilling, the stretching of the tubing string has become a greater issue in oil or gas operations.

In these situations, being able to effectively locate a tool within a wellbore and maintain the tool's location is difficult. The difficulty is increased in off-shore drilling due to rig heave from rough water surrounding the rig. Rig heave can cause unintended upward and downward force and/or movement of the tubing strings and consequently downhole tools. As used herein, the relative terms "upward" and "above" and all grammatical variations thereof means in a direction or location closer to the wellhead. As used herein, the relative terms "downward" and "below" and all grammatical variations thereof means in a direction or location farther away from the wellhead.

Due to these difficulties, it is often times desirable to locate a tool within a wellbore using a downward weight on the tool. As used herein, the terms "downward weight" and "weight-down" are synonymous and mean causing or allowing a downward force to be applied to a tool or wellbore component. For example, causing a downward force can involve pushing on a section of a tubing string from an area above the wellhead. By way of another example, allowing a downward force can involve cessation of an upward force or movement on a section of tubing string from an area above the wellhead. This can include, without limitation, setting the tubing string back down (the downward force) after the tubing string has been picked up (the upward force). Some of the other attempts to locate a tool involve using a J-slot type locating system to locate the tool using reciprocation of the work string, or simple weight-down collets. However, use of these other systems does not allow the tool to be located in more than one position, additional components or length to the tool mandrel has to be added in order for the tool to be located in more than one position, or more than one type of action has to be performed on the tool in order for the tool to be located in more than one position. When more than one type of action has to be performed, it can be referred to as a dual- or multi-action tool or assembly. If only one type of action has to be performed, it can be referred to as a single-action tool or assembly.

Currently, there are no assemblies that can be used to locate a tool in two positions using a single action that are both weight-down positions. Therefore, there is a need for a single-action, dual position assembly that can be used to locate and maintain a tool in the two positions. It has been discovered that a locating assembly can be used to locate and maintain a wellbore tool in at least two positions in the wellbore. The locating assembly locates and maintains the tool in the positions via application of a first and second downward force.

According to an embodiment, a locating assembly comprises: an inner mandrel; an outer mandrel, wherein the outer mandrel is connected to the inner mandrel via a frangible device; and a positioning device, wherein the positioning device is connected to the outer mandrel.

According to another embodiment, a method of locating and maintaining a tool in a wellbore in at least two positions comprises: causing or allowing a first downward force to be applied to at least a portion of the locating assembly, wherein the locating assembly is directly or operatively connected to the tool, wherein the application of the first downward force causes the positioning device to move to a first position, and wherein when the positioning device is in the first position, the tool is located and maintained in a first position; and causing or allowing a second downward force to be applied to at least a portion of the locating assembly, wherein the application of the second downward force causes the inner mandrel to move relative to the outer mandrel into a second position, and wherein when the inner mandrel is in the second position, the tool is located and maintained in a second position.

Figure 1B:
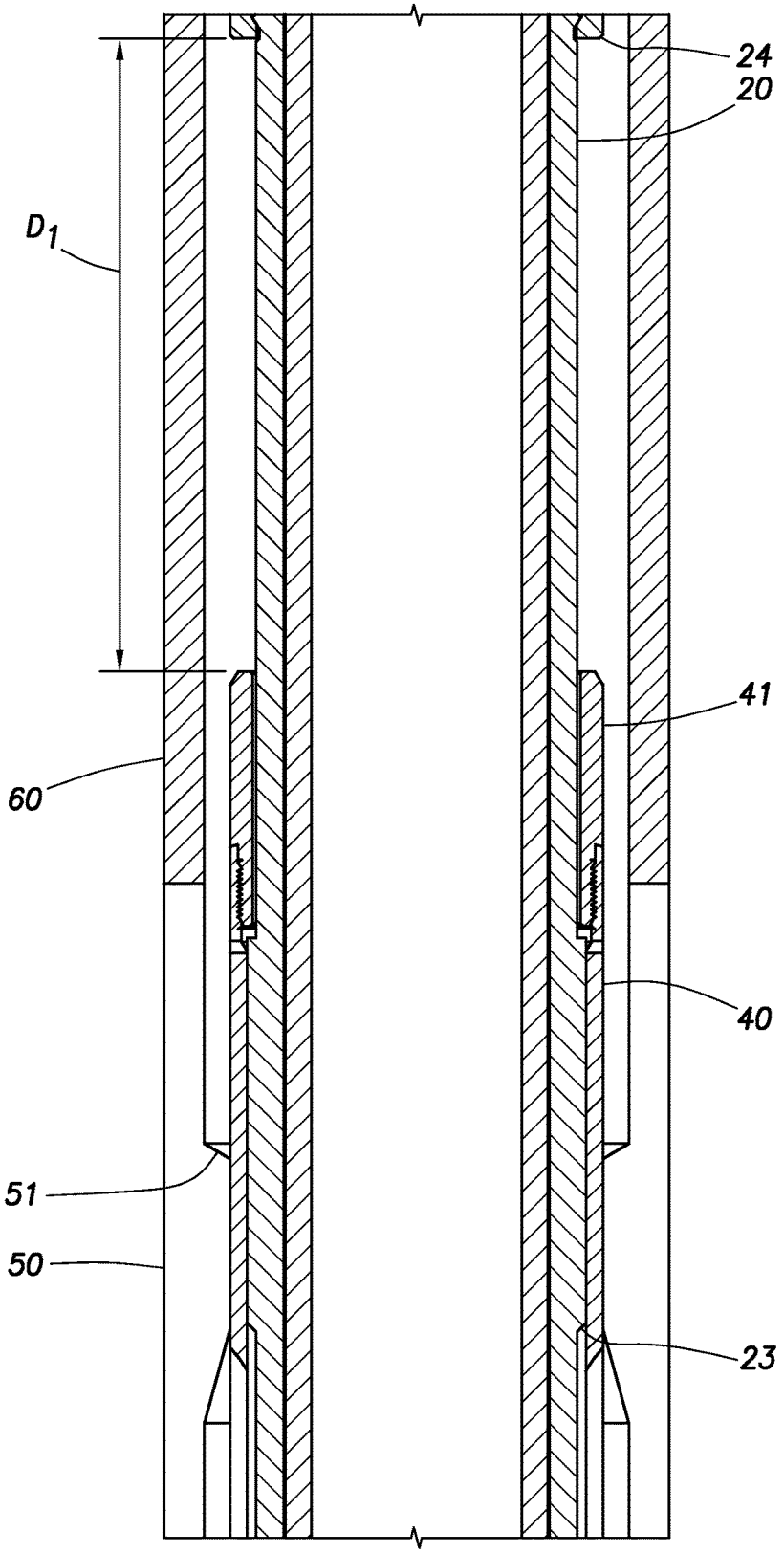
Figure 1C:
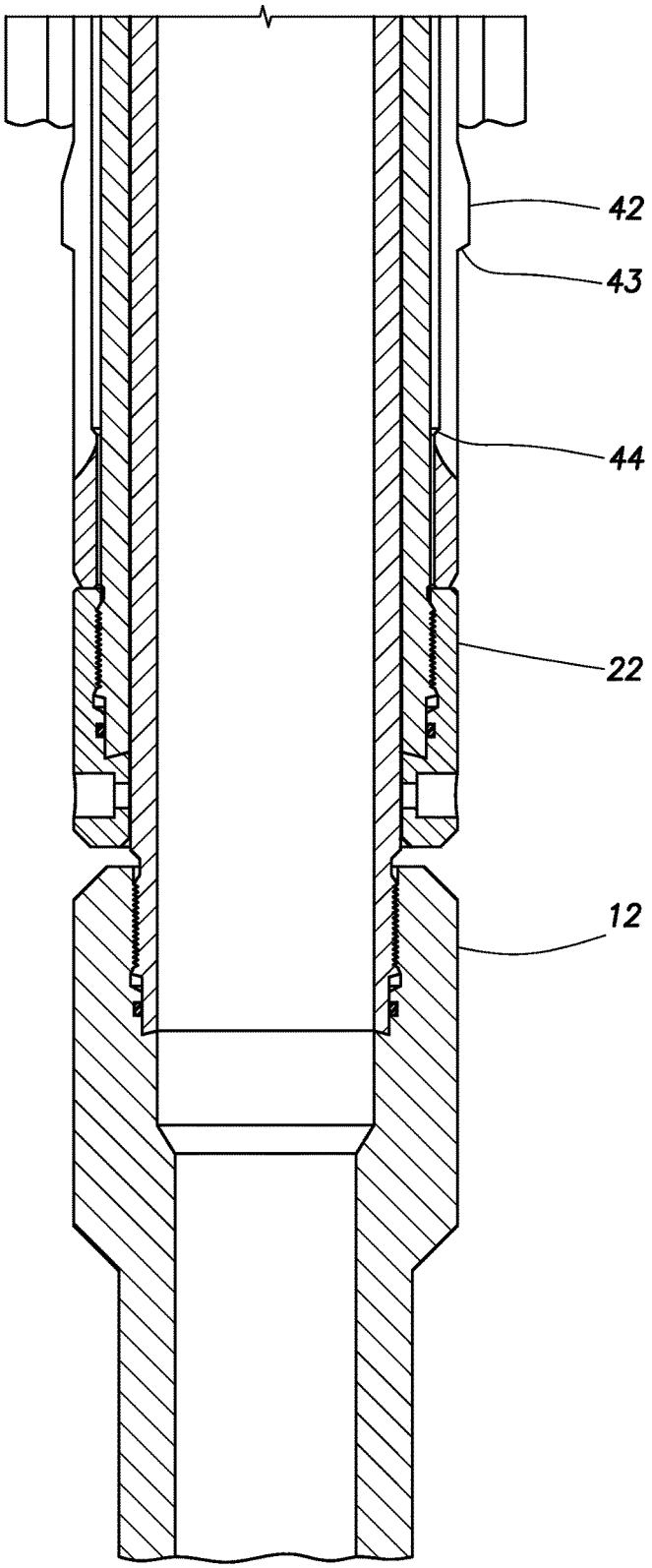
Figure 2A:
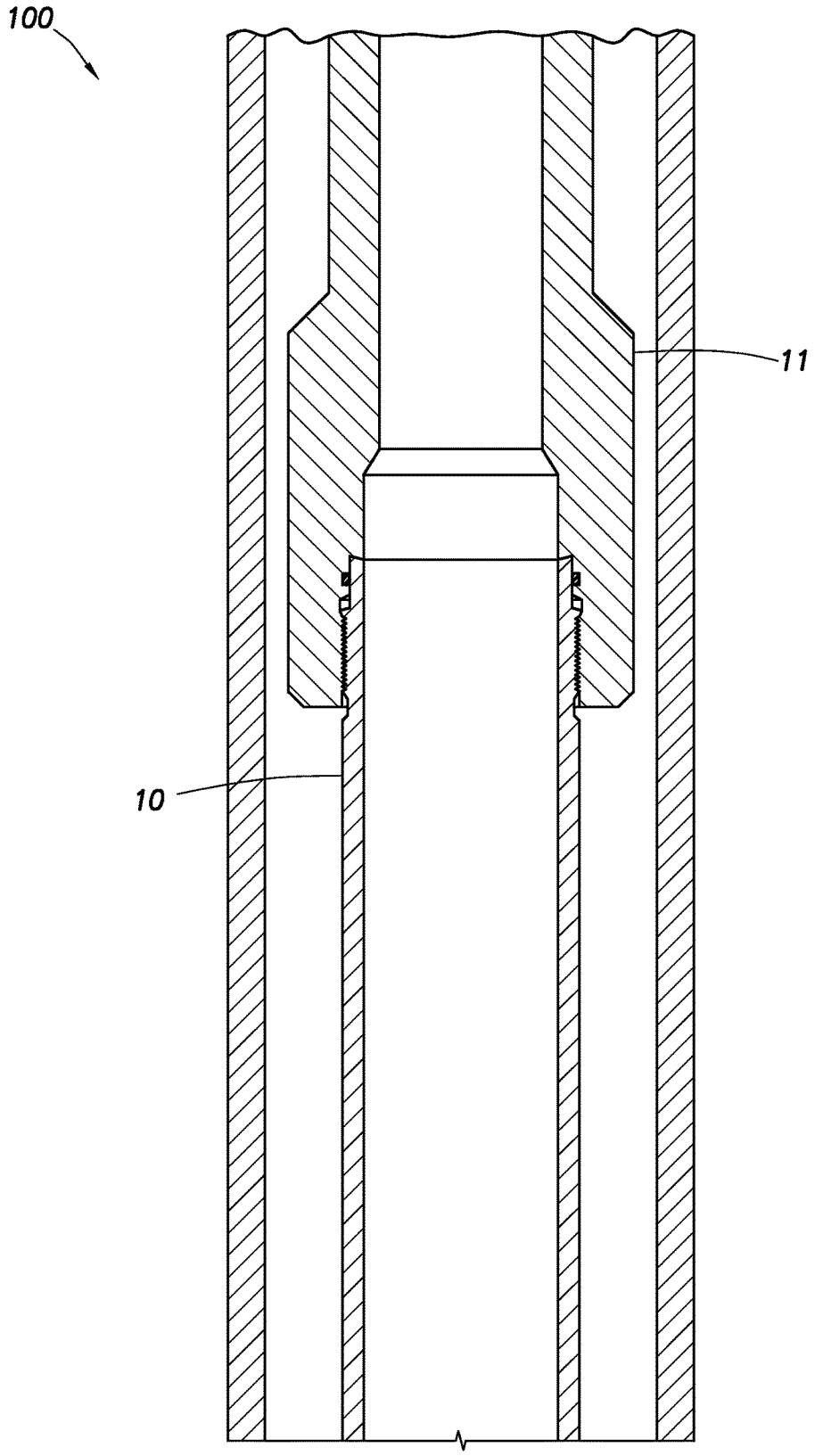
FIGS. 2A-2D is a schematic illustration of the weight-down locating assembly after movement of the assembly into the first weight-down position.
Figure 2B:
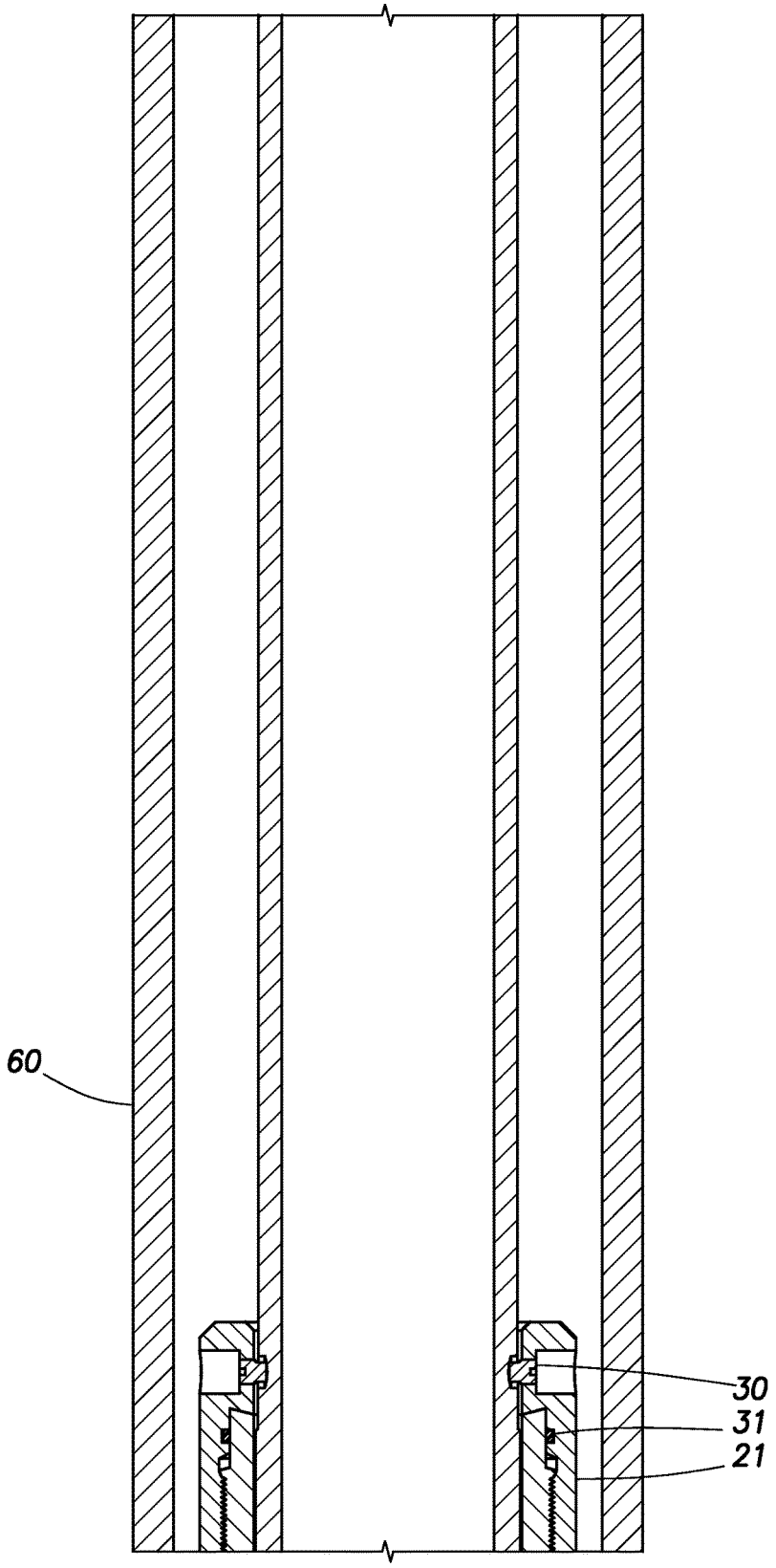
Figure 2C:
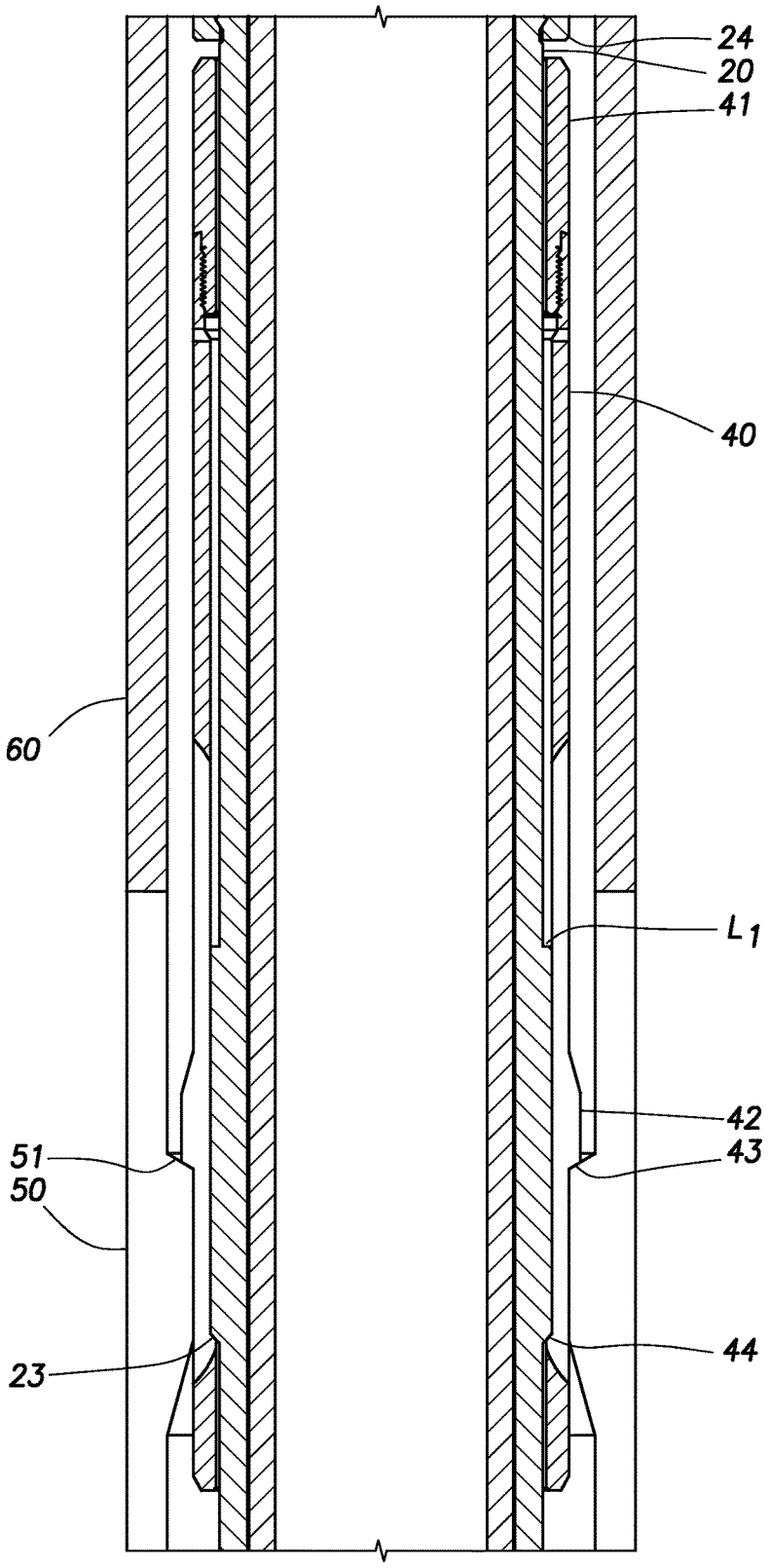
Figure 2D:
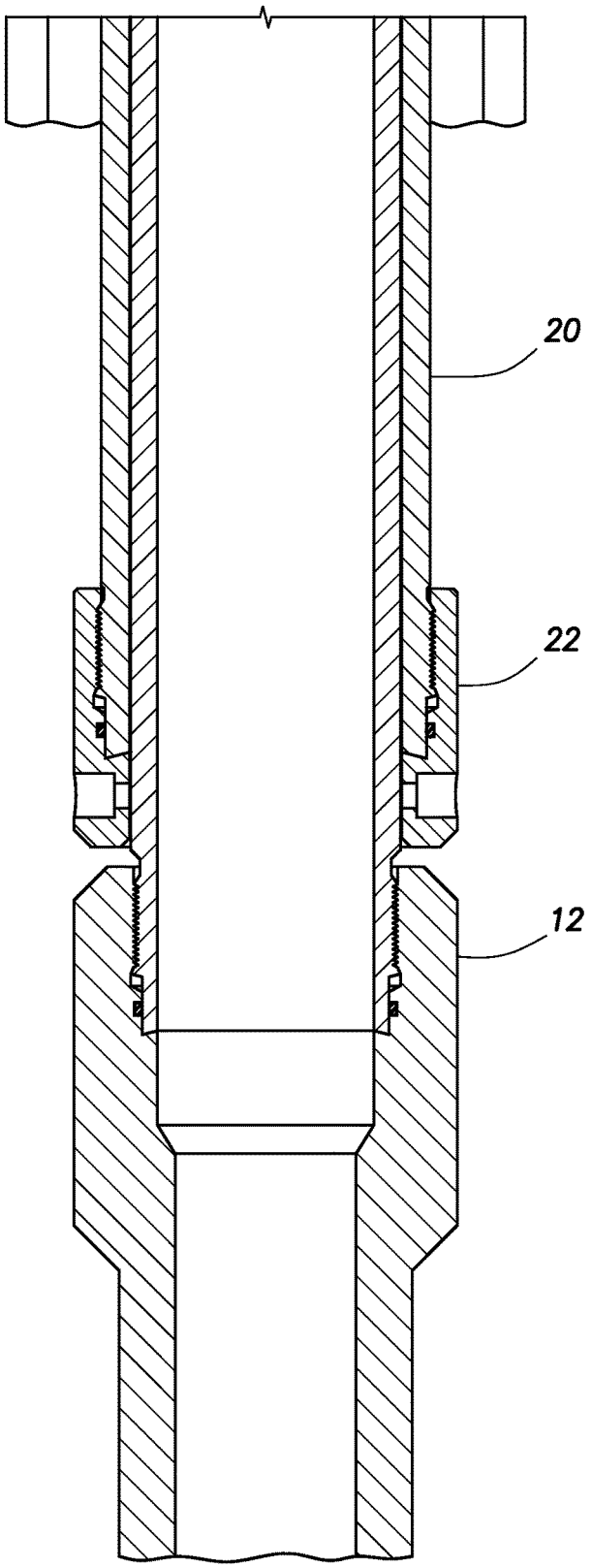
Figure 3A:
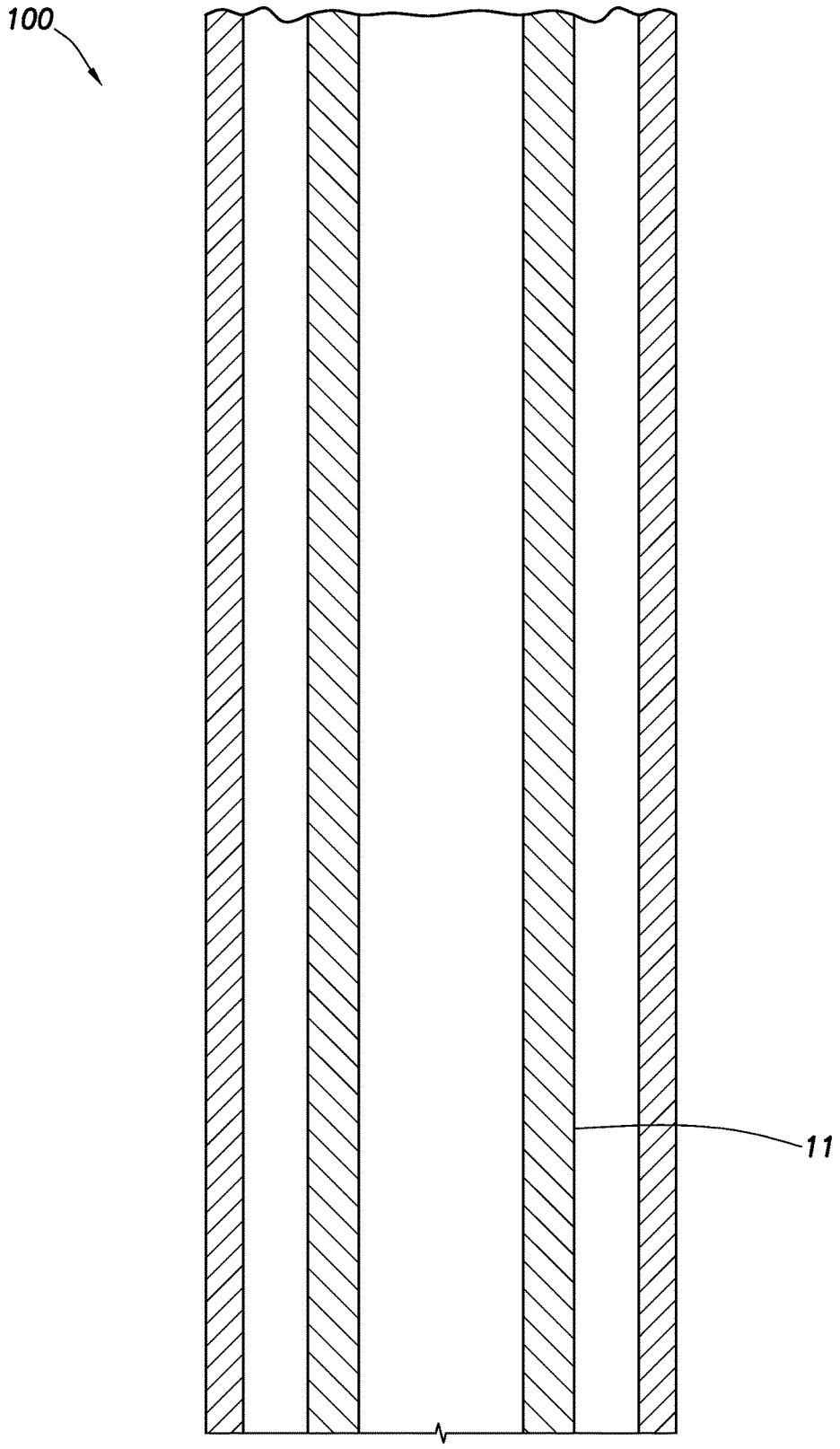
FIGS. 3A-3E is a schematic illustration of the weight-down locating assembly after movement of the assembly into the second weight-down position.
Figure 3B:
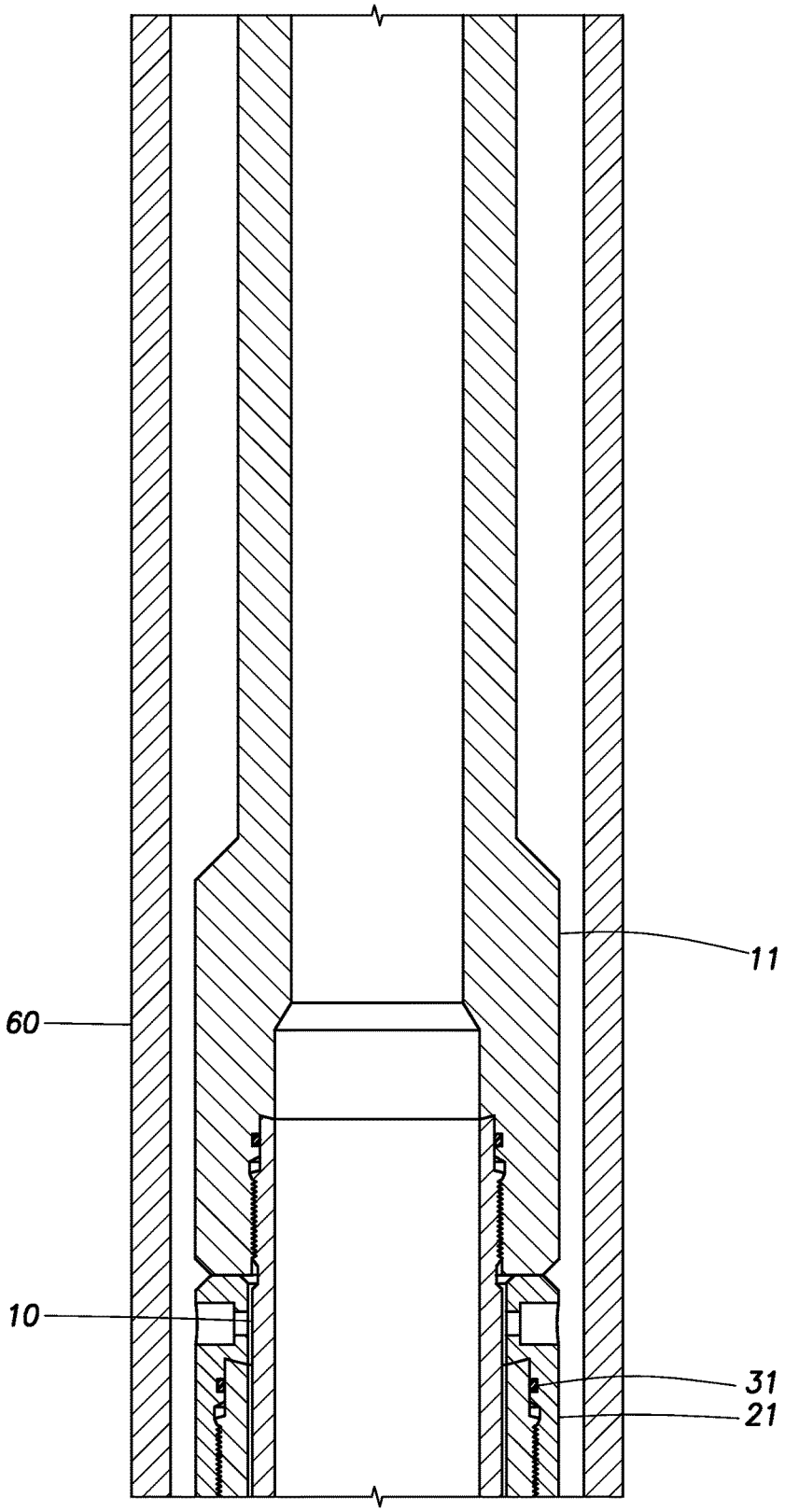
Figure 3C:
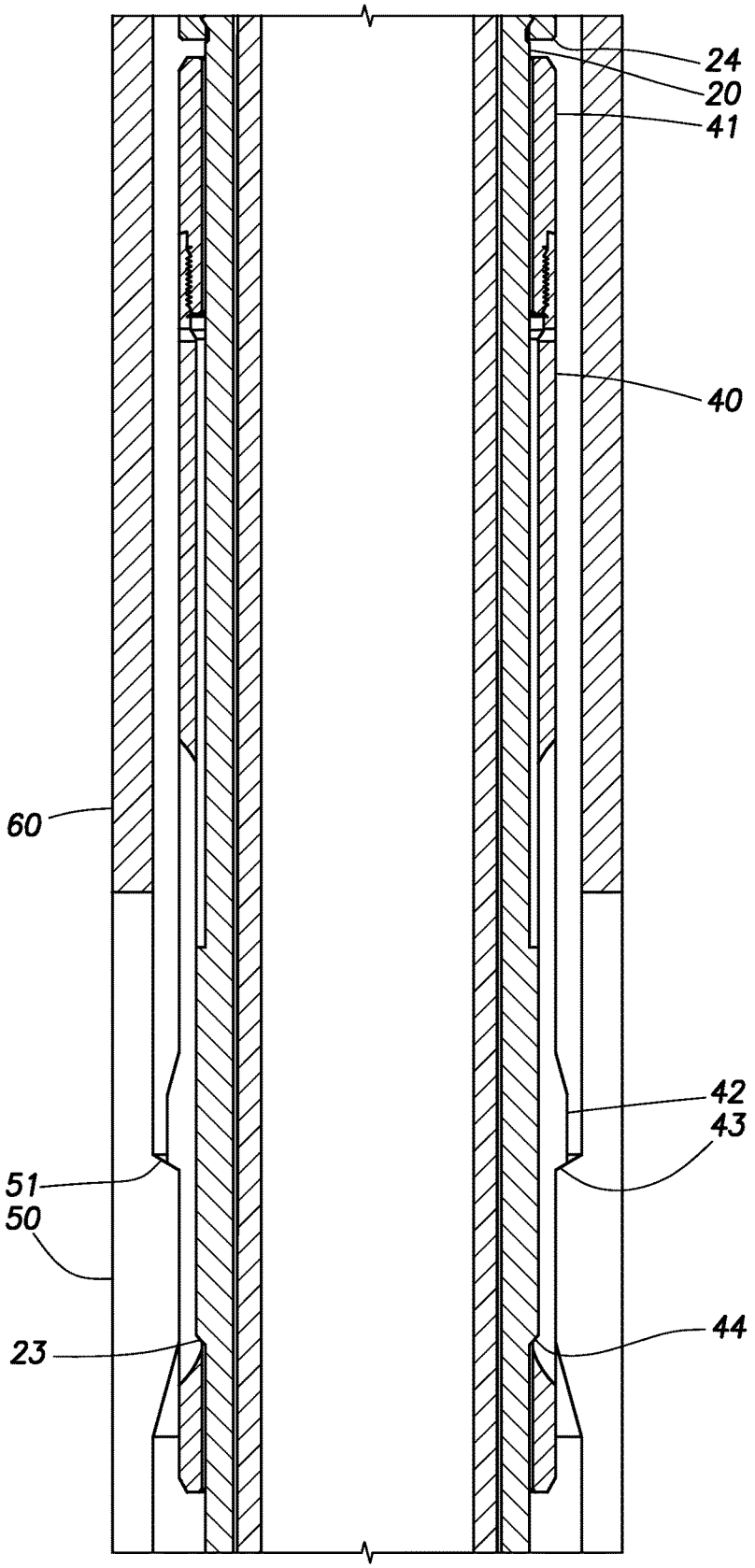
Figure 3D:
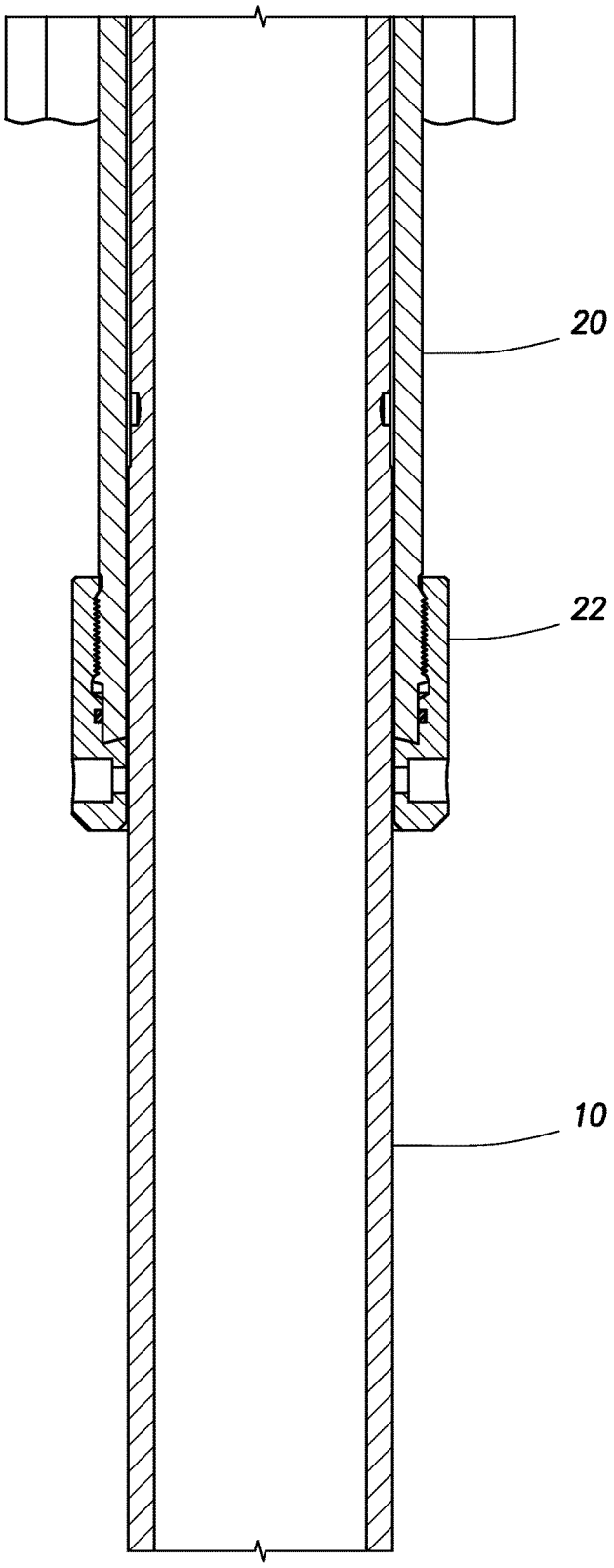
Figure 3E:
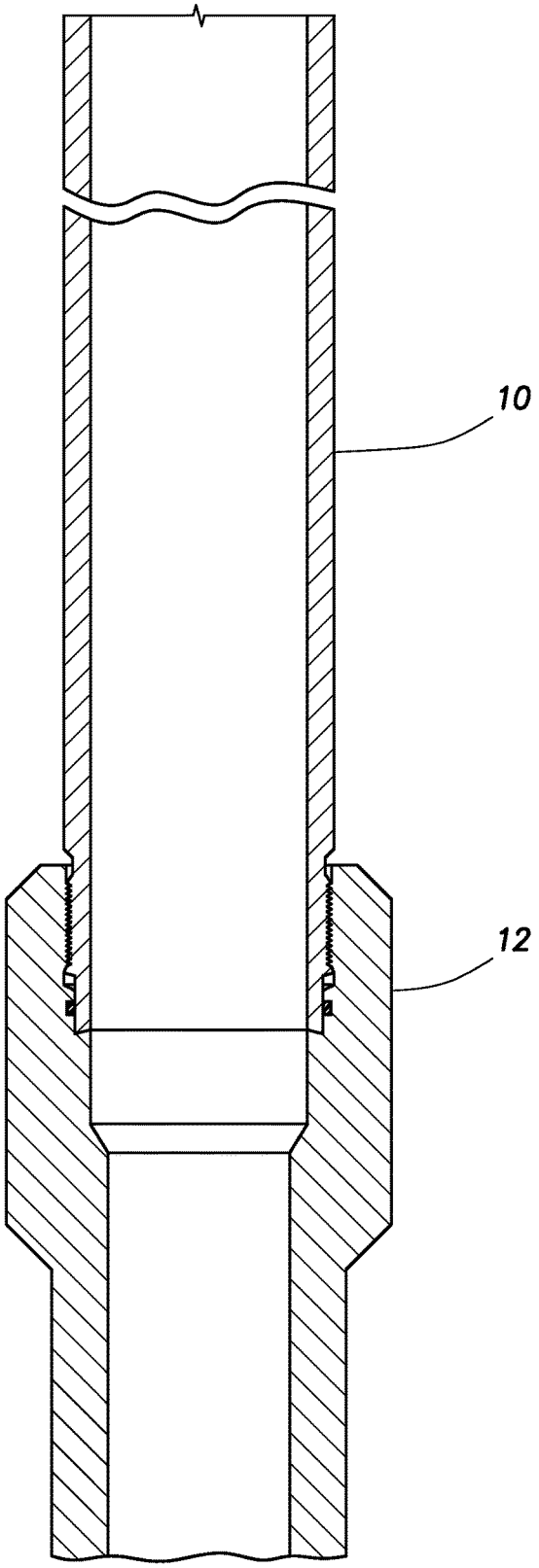

Turning to the Figures, FIGS. 1A-1C is a schematic illustration of the locating assembly 100 prior to application of the first and second downward forces. The methods can further include introducing the locating assembly 100 into a wellbore. The introduction of the locating assembly 100 can be running the assembly into the wellbore. As such, FIGS. 1A-1C depict the locating assembly 100 prior to and during introduction into the wellbore.

The locating assembly 100 includes the inner mandrel 10 and the outer mandrel 20, wherein the outer mandrel 20 is connected to the inner mandrel 10 via the frangible device 30. The outer mandrel 20 can be sealingly connected to the inner mandrel 10 via one or more seals 31, for example O-rings. The frangible device 30 can be any device that is capable of withstanding a predetermined amount of force and capable of releasing at a force above the predetermined amount of force. The frangible device 30 can be, for example, a shear pin, a shear screw, a shear ring, a load ring, a lock ring, a pin, or a lug. There can also be more than one frangible device 30 that connects the inner mandrel 10 to the outer mandrel 20. The frangible device 30, or multiple frangible devices can be selected based on the force rating of the device, the total number of devices used, and the predetermined amount of force needed to release the device. For example, if the total force required to break or shear the frangible devices is 15,000 pounds force ($lb_f$) and each frangible device has a rating of 5,000 $lb_f$, then a total of three frangible devices may be used.

The inner mandrel 10 can include a top sub 11 and a bottom sub 12. The outer mandrel can include a top outer mandrel cap 21, a bottom outer mandrel cap 22, an outer mandrel shoulder 23, and an upper positioning device shoulder 24. The cap 41 can be located adjacent to the upper positioning device shoulder 24.

The locating assembly 100 also includes the positioning device 40. The positioning device can be any device that is capable of positioning the tool in a first position after application of the first downward force and is capable of positioning the tool in a second position after application of the second downward force. The positioning device 40 can be, for example, a collet, a dog, c-ring. The positioning device 40 can include a cap 41, a raised portion or finger 42, and at least one shoulder. The positioning device 40 can include an indicating shoulder 43 and a finger shoulder 44.

Referring to FIGS. 2A-2D, the locating assembly 100 can further comprise at least one indicator coupling 50, wherein the indicator coupling 50 is positioned adjacent to the outer surface of the positioning device 40. The indicator coupling 50 can include a locating shoulder 51.

Although described in more detail with reference to FIG. 4, the locating assembly 100 is directly or operatively connected to a tool in a wellbore. The locating assembly 100 can also be directly or operatively connected to more than one tool in the wellbore.

FIGS. 2A-2D is a schematic illustration of the locating assembly 100 after the assembly has moved into the first weight-down position. The methods include causing or allowing a first downward force to be applied to at least a portion of the locating assembly 100, wherein the application of the first downward force causes the positioning device 40 to move to a first position, and wherein when the positioning device 40 is in the first position, the tool is located and maintained in a first position.

The methods can include applying an upward force on at least a portion of the locating assembly 100 prior to the application of the first downward force. As can be seen when comparing FIGS. 1A-1C to FIGS. 2A-2D, an application of the upward force can cause the positioning device 40 to move upwards along the outside of the outer mandrel 20. The finger 42 can slide past the indicator coupling 50. The indicating shoulder 43 of the positioning device 40 can now be located above the locating shoulder 51 of the indicator coupling 50. The upward travel of the positioning device 40 can be halted when the cap 41 comes in contact with the upper positioning device shoulder 24 and/or the finger shoulder 44 shoulders against the outer mandrel shoulder 23. In this manner, the positioning device 40 is incapable of any further upward travel along the outside of the outer mandrel 20. The distance $D_1$ between the cap 41 and the upper positioning device shoulder 24 can be adjusted and predetermined. The distance $D_1$ can be adjusted based in part on the length necessary for the indicating shoulder 43 to be located above the locating shoulder 51 after the application of the upward force. The outer diameter (O.D.) of the outer mandrel 20 at location $L_1$ can be greater than the O.D. of the outer mandrel 20 at other locations along the outer mandrel 20. The greater O.D. at location $L_1$ can prop the finger 42 of the positioning device 40 in an expanded, outward position.

After the positioning device 40 moves upward along the outside of the outer mandrel 20, the first downward force can be applied. As stated previously, causing the application of any of the downward forces can include applying a force, such as lowering a section of a tubing string, from an area above the wellhead. The step of allowing the application of the downward force can include cessation of an application of the upward force or movement on the portion of the positioning device 40. As can still be seen in FIGS. 2A-2D, when the first downward force is applied, the positioning device 40 can move to the first position. The positioning device 40 can move downwards along the outside of the outer mandrel 20 into the first position. The positioning device 40 can also be maintained in the first position for a desired amount of time. When the positioning device 40 is moved to the first position, the tool can also be located in the first position. When the positioning device 40 is maintained in the first position, the tool can also be maintained in the first position. The positioning device 40 can be maintained in the first position by preventing the positioning device 40 from moving downward any further along the outside of the outer mandrel 20. Further downward movement can be prevented by the positioning device 40 shouldering up against the indicator coupling 50 via the indicating shoulder 43 of the positioning device 40 and the locating shoulder 51 of the indicator coupling 50. The shouldered connection can be maintained in part due to the greater O.D. of the outer mandrel 20 at location 1 $L_1$, which maintains the finger 42 of the positioning device 40 in the expanded position. Any subsequent downward force does not move the positioning device 40 further down on the outer mandrel 20.

FIGS. 3A-3E is a schematic illustration of the locating assembly 100 after the assembly has moved into the second weight-down position. The methods include causing or allowing a second downward force to be applied to at least a portion of the locating assembly 100, wherein the application of the second downward force causes the inner mandrel 10 to move relative to the outer mandrel 20 into a second position, and wherein when the inner mandrel 10 is in the second position, the tool is located and maintained in a second position.

According to an embodiment, the second downward force is caused to be applied to the portion of the locating assembly. The downward force can be applied via pushing down or the application of weight on the inner mandrel 10 from an area at or near the wellhead. The second downward force can be predetermined. Preferably, the second downward force is much greater than the first downward force. Upon application of the second downward force, the frangible device 30 can shear, break, or compress. As discussed previously, the frangible device 30 can be designed to shear, break, or compress at the predetermined second downward force. According to an embodiment, the first downward force is less than the force necessary to shear, break, or compress the frangible device 30. According to another embodiment, the force necessary to shear, break, or compress the frangible device 30 is greater than the force exerted on the frangible device 30 due to the weight of the tubing string or due to rig heave. In this manner, the frangible device 30 is prevented from prematurely shearing, breaking, or compressing prior to and during application of the first downward force and prior to the application of the second downward force. According to yet another embodiment, the locating assembly 100 can further include a safety device (not shown). The safety device can be used in conjunction with the frangible device 30 such that when the frangible device 30 breaks, shears, or compresses, a release mechanism of the safety device is activated which allows the inner mandrel 10 to move to the second position.

After the frangible device 30 shears, breaks, or compresses, the inner mandrel 10 is no longer connected to the outer mandrel 20 via the frangible device 30. After the inner mandrel 10 is disconnected from the outer mandrel 20, the inner mandrel 10 is free to move upwards or downwards relative to the outer mandrel 20. According to an embodiment, after the inner mandrel 10 is disconnected from the outer mandrel 20, the inner mandrel 10 moves downward within a wellbore relative to the outer mandrel 20 into the second position and can be maintained in the second position. When the inner mandrel 10 is moved to the second position, the tool can also be located in the second position. When the inner mandrel 10 is maintained in the second position, the tool can also be maintained in the second position. The inner mandrel 10 can be maintained in the second position by preventing the inner mandrel 10 from moving downward any further relative to the outer mandrel 20. The inner mandrel 10 can abut the outer mandrel 20 via the bottom of the top sub 11 of the inner mandrel 10 and the top outer mandrel cap 21 of the outer mandrel 20. Therefore, any subsequent downward force does not move the inner mandrel 10 further down relative to the outer mandrel 20. The distance $D_2$ between the top sub 11 and the top outer mandrel cap 21 can be adjusted and predetermined. The distance $D_2$ can be adjusted based in part on the overall desired movement of the locating assembly from the first to the second weight-down positions and/or the distance needed to be able to differentiate between the first and second weight-down positions from the surface.

Figure 4:
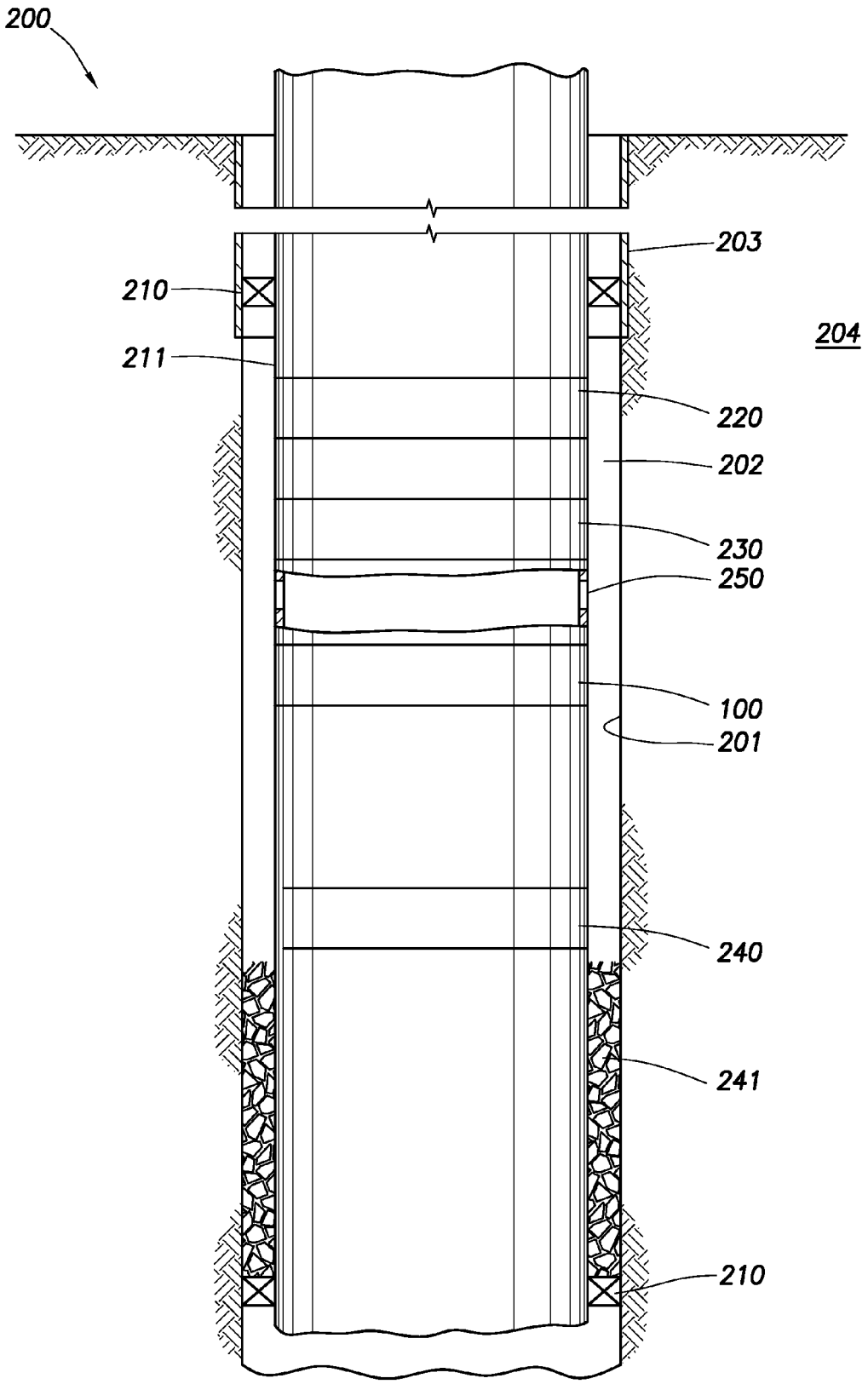
FIG. 4 is a schematic illustration of a well system comprising the dual position, weight-down locating assembly.

FIG. 4 is a schematic illustration of a well system 200 including the locating assembly 100. It should be noted that the well system 200 illustrated in the drawings and described herein is merely one example of a wide variety of well systems in which the principles of this disclosure can be utilized. It should be clearly understood that the principles of this disclosure are not limited to any of the details of the well system 200, or components thereof, depicted in the drawings or described herein. Furthermore, the well system 200 can include other components not depicted in the drawing. The well system 200 can include at least one wellbore 201. The wellbore 201 can penetrate a subterranean formation 204. The subterranean formation 204 can be a portion of a reservoir or adjacent to a reservoir. The subterranean formation can be located off shore or on land. The wellbore 201 can include a casing 203. The wellbore 201 can include a cased-hole wellbore portion and/or an open-hole wellbore portion. The locating assembly 100 can be positioned in the cased-hole wellbore portion or the open-hole wellbore portion. More than one locating assemblies 100 can also be positioned within the wellbore 201 in a cased-hole and/or open-hole wellbore portions. The wellbore 201 can include wellbore sections that can vary from vertical to horizontal to updip.

One or more tubing strings 211, for example a production tubing, can be installed in the wellbore 201. The well system 200 can include one or more annuli 202. The annuli can be the space between the wellbore 201 and the outside of a tubing string 211 in an open-hole wellbore; the space between the wellbore 201 and the outside of a casing 203 in a cased-hole wellbore; the space between the inside of a casing 203 and the outside of a tubing string 211 in a cased-hole wellbore; and the space between any mandrels, sleeves, etc. of any of the tools. The well system can include one or more ports 250. The ports 250 can be used to direct fluid flow through the wellbore and/or tools into one or more areas or annuli.

The locating assembly 100 is directly or operatively connected to a tool. The locating assembly 100 can also be connected to more than one tool. According to an embodiment, the locating assembly 100 is connected to a packer 210, a service tool 220, a reverse out check "ROC" tool 230, and/or a gravel pack assembly 240. The well system 200 can also include gravel slurry 241 located or introduced in an annulus between the outside of the tubing string 211 and the wall of the wellbore 201. The specific orientation of the one or more tools can depend on the specific oil or gas operation to be performed. It is to be understood, that while FIG. 4 depicts some commonly used downhole tools, the locating assembly 100 could be connected to any downhole tool not specifically mentioned or depicted in the drawings. Moreover, not every tool depicted in the drawings needs to be included in the well system 200.

The following is one example of using the locating assembly 100 to locate and maintain a tool in the first and second weight-down positions. It is to be understood that the following example is not the only example that could be given and is not meant to limit the embodiments disclosed herein. The locating assembly 100 can be used with the packer 210. The packer 210 can be run into the wellbore 201 with the locating assembly 100 as depicted in FIGS. 1A-1C. During the running and setting of the packer 210, one or more fluid flow paths can be opened to the tubing string 211 and an annulus 202 such that fluid communication exists with the wall of the wellbore 201. After the packer 210 is run, the packer 210 can be set such that the packer is anchored against the inside of the casing 203. After the setting of the packer, the packer may need to be tested (called the test position). The test position can be the first weight-down position. It is beneficial to be able to accurately locate a tool and maintain that tool so an operator can ensure that the proper ports are either opened or closed, or one port is opened and another port is closed. In the first weight-down or test position, ports located within the service tool 220 and the ROC tool 230 can be closed to prevent fluid flow through these two tools, while other ports can be opened to allow fluid flow into the annulus 202. After the packer has been tested, the tools can be located and maintained in the second weight-down position or a circulate position. The circulate position can be used to circulate fluids within the wellbore. In the second weight-down or circulate position, ports located within the service tool 220 and the ROC tool 230 can now be opened to allow fluid flow through these two tools. Other cross-over ports can be used to allow fluid flow into the annulus 202 and up the tubing string 211 (circulate) or flow through the tubing string and up the annulus (reverse circulate). As will be appreciated by one of ordinary skill in the art, it is beneficial to ensure that the tools are located and maintained in the first and second weight-down position so that an operator can know that the proper flow paths are maintained.

The methods can further include other steps used in completion operations. Other completion steps can include, but are not limited to, introducing a fluid into the well and removal of one or more tools located in the wellbore. The locating assembly can also be removed after its intended function is no longer needed.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While apparatus (such as the packer assembly) and methods are described in terms of "comprising," "containing," or "including" various components or steps, the compositions and methods also can "consist essentially of" or "consist of" the various components and steps. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of locating and maintaining a tool in a wellbore in at least two positions comprising:

causing or allowing a first downward force to be applied to at least a portion of a locating assembly, wherein the locating assembly is directly or operatively connected to the tool, and wherein the locating assembly comprises:

an inner mandrel;

an outer mandrel, wherein the outer mandrel is connected to the inner mandrel via a frangible device; and a positioning device, wherein the positioning device is connected to the outer mandrel;

wherein the application of the first downward force causes the positioning device to move to a first position, and wherein when the positioning device is in the first position, the tool is located and maintained in a first position; and causing or allowing a second downward force to be applied to at least a portion of the locating assembly, wherein the application of the second downward force causes the inner mandrel to move relative to the outer mandrel into a second position, and wherein when the inner mandrel is in the second position, the tool is located and maintained in a second position.

2. The method according to claim 1, wherein the frangible device is a shear pin, a shear screw, a shear ring, a load ring, a lock ring, a pin, or a lug.

3. The method according to claim 1, wherein the positioning device is a collet, a dog, or a c-ring.

4. The method according to claim 1, wherein the locating assembly further comprises at least one indicator coupling, wherein the indicator coupling is positioned adjacent an outer surface of the positioning device.

5. The method according to claim 4, further comprising applying an upward force on at least a portion of the locating assembly prior to the application of the first downward force.

6. The method according to claim 5, wherein the application of the upward force causes the positioning device to move upwards along the outside of the outer mandrel.

7. The method according to claim 6, wherein the positioning device further comprises a cap and the outer mandrel further comprises an upper positioning device shoulder, wherein the cap is positioned adjacent to the outer mandrel shoulder, and wherein the upward movement of the positioning device is halted when the cap comes in contact with the upper positioning device shoulder.

8. The method according to claim 6, wherein the positioning device further comprises an indicating shoulder and the indicator coupling further comprises a locating shoulder, and wherein after application of the upward force, the indicating shoulder of the positioning device is located above the locating shoulder of the indicator coupling.

9. The method according to claim 8, wherein the positioning device moves downwards along the outside of the outer mandrel into the first position.

10. The method according to claim 9, wherein the positioning device is maintained in the first position by preventing the positioning device from moving downward any further along the outside of the outer mandrel, and wherein further downward movement is prevented by the positioning device shouldering up against the indicator coupling via the indicating shoulder of the positioning device and the locating shoulder of the indicator coupling.

11. The method according to claim 1, wherein the second downward force is greater than the first downward force.

12. The method according to claim 1, wherein upon application of the second downward force, the frangible device shears, breaks, or compresses.

13. The method according to claim 12, wherein the second downward force is predetermined.

14. The method according to claim 13, wherein the frangible device is designed to shear, break, or compress at the predetermined second downward force.

15. The method according to claim 14, wherein the first downward force is less than the force necessary to shear, break, or compress the frangible device.

16. The method according to claim 14, wherein after the frangible device shears, breaks, or compresses, the inner mandrel is no longer connected to the outer mandrel via the frangible device.

17. The method according to claim 1, wherein the tool is a packer.

18. A method of locating and maintaining a tool in a wellbore in at least two positions comprising:

causing or allowing a first downward force to be applied to at least a portion of a locating assembly, wherein the locating assembly is directly or operatively connected to the tool, and wherein the locating assembly comprises:

an inner mandrel;

an outer mandrel, wherein the outer mandrel is connected to the inner mandrel via a frangible device; and a positioning device, wherein the positioning device is connected to the outer mandrel;

wherein the application of the first downward force causes the positioning device to move to a first position, and wherein when the positioning device is in the first position, the tool is located and maintained in a first position; and causing or allowing a second downward force to be applied to at least a portion of the locating assembly, wherein the application of the second downward force causes the inner mandrel to move relative to the outer mandrel into a second position by shearing, breaking, or compressing the frangible device, and wherein when the inner mandrel is in the second position, the tool is located and maintained in a second position;

wherein when the inner mandrel is disconnected from the outer mandrel, the inner mandrel moves downward within the wellbore relative to the outer mandrel into the second position and is maintained in the second position.

19. The method according to claim 18, wherein the inner mandrel further comprises a top sub and the outer mandrel further comprises a top outer mandrel cap, and wherein the inner mandrel is maintained in the second position by preventing the inner mandrel from moving downward any further relative to the outer mandrel, and wherein the prevention of further downward movement occurs via the bottom of the top sub of the inner mandrel abutting the top outer mandrel cap of the outer mandrel.

20. A locating assembly comprising:

an inner mandrel;

an outer mandrel, wherein the outer mandrel is connected to the inner mandrel via a frangible device; and a positioning device, wherein the positioning device is connected to the outer mandrel;

wherein the locating assembly is directly or operatively connected to a tool, wherein the tool is located within a wellbore, wherein an application of a first downward force causes the positioning device to move to a first position, and wherein when the positioning device is in the first position, the tool is located and maintained in a first position, and wherein an application of a second downward force causes the inner mandrel to move relative to the outer mandrel into a second position, and wherein when the inner mandrel is in the second position, the tool is located and maintained in a second position.

* * * * *